US011654680B2

(12) United States Patent
Choy et al.

(10) Patent No.: US 11,654,680 B2
(45) Date of Patent: May 23, 2023

(54) FLUIDIC EJECTION DIES WITH ENCLOSED CROSS-CHANNELS

(71) Applicant: HEWLETT-PACKARD DEVELOPMENT COMPANY, L.P., Spring, TX (US)

(72) Inventors: Si-Iam Choy, Corvallis, OR (US); Michael W. Cumbie, Corvallis, OR (US); Chien-Hua Chen, Corvallis, OR (US); Jeffrey R. Pollard, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 199 days.

(21) Appl. No.: 17/340,570

(22) Filed: Jun. 7, 2021

(65) Prior Publication Data

US 2021/0291547 A1 Sep. 23, 2021

Related U.S. Application Data

(63) Continuation of application No. 16/629,366, filed as application No. PCT/US2017/044738 on Jul. 31, 2017, now Pat. No. 11,059,291.

(51) Int. Cl.
*B41J 2/14* (2006.01)
*B41J 2/16* (2006.01)
(Continued)

(52) U.S. Cl.
CPC ..... *B41J 2/14145* (2013.01); *B41J 2/14032* (2013.01); *B41J 2/1603* (2013.01);
(Continued)

(58) Field of Classification Search
CPC ..... B41J 2/21; B41J 2/14032; B41J 2/17503; B41J 2/1626; B41J 2/1631; B41J 2/1404;
(Continued)

(56) References Cited

U.S. PATENT DOCUMENTS 6,244,694 B1 6/2001 Weber
6,513,896 B1 2/2003 Kawamura
(Continued)

FOREIGN PATENT DOCUMENTS

CN 102470672 5/2012
CN 102971151 3/2013
(Continued)

OTHER PUBLICATIONS

Marc K. Torrey, Silicon Mems Printhead FAQ, Nov. 23, 2016, <https://www.linkedin.com/pulse/silicon-mems-printhead-faq-tim-phillips>.

*Primary Examiner* — An H Do
(74) *Attorney, Agent, or Firm* — Foley & Lardner LLP

(57) ABSTRACT

In one example in accordance with the present disclosure, a fluidic ejection die is described. The die includes an array of nozzles. Each nozzle includes an ejection chamber and an opening. A fluid actuator is disposed within the ejection chamber. The fluidic ejection die also includes an array of passages, formed in a substrate, to deliver fluid to and from the ejection chamber. The fluidic ejection die also includes an array of enclosed cross-channels. Each enclosed cross-channel of the array of enclosed cross-channels is fluidly connected to a respective plurality of passages of the array of passages.

20 Claims, 10 Drawing Sheets

(51) Int. Cl.
*B41J 2/175* (2006.01)
*B41J 2/21* (2006.01)

(52) U.S. Cl.
CPC ..... *B41J 2/1623* (2013.01); *B41J 2/1628* (2013.01); *B41J 2/17503* (2013.01); *B41J 2/21* (2013.01); *B41J 2202/12* (2013.01)

(58) Field of Classification Search
CPC .... B41J 2/1632; B41J 2/1634; B41J 2/14145; B41J 2/1623; B41J 2/175; B41J 2/1628; B41J 2/1603; B41J 2202/12; B41J 2202/02
See application file for complete search history.

(56) References Cited

U.S. PATENT DOCUMENTS

| | | | | |
|---|---|---|---|---|
| 8,109,607 | B2 | 2/2012 | Chen | |
| 8,240,815 | B2 | 8/2012 | Uyama | |
| 8,382,253 | B1 | 2/2013 | Rivas | |
| 8,438,730 | B2 | 5/2013 | Ciminelli | |
| 8,449,086 | B2 | 5/2013 | Price | |
| 8,672,463 | B2 | 3/2014 | Essen | |
| 8,757,783 | B2 | 6/2014 | Govyadinov | |
| 8,814,293 | B2 | 8/2014 | Strunk | |
| 9,211,721 | B2 | 12/2015 | Govyadinov | |
| 9,221,247 | B2 | 12/2015 | Cruz-Uribe | |
| 11,065,883 | B2 * | 7/2021 | Chen | B41J 2/14145 |
| 11,155,086 | B2 * | 10/2021 | Choy | B41J 2/14145 |
| 11,292,265 | B2 * | 4/2022 | Choy | B41J 2/18 |
| 2005/0018016 | A1 | 1/2005 | Silverbrook | |
| 2006/0131264 | A1 | 6/2006 | Kawamura | |
| 2010/0328409 | A1 | 12/2010 | Matsufuji | |
| 2011/0018940 | A1 | 1/2011 | Mcavoy | |
| 2011/0205303 | A1 | 8/2011 | Pan | |
| 2012/0160925 | A1 | 6/2012 | Hoisington et al. | |
| 2014/0063132 | A1 | 3/2014 | Scheffelin | |
| 2014/0104348 | A1 | 4/2014 | Owaki | |
| 2016/0016404 | A1 | 1/2016 | Chen | |
| 2016/0288499 | A1 | 10/2016 | Sugahara | |
| 2017/0028722 | A1 | 2/2017 | Chen | |
| 2017/0197417 | A1 | 7/2017 | Karita | |

FOREIGN PATENT DOCUMENTS

| | | |
|---|---|---|
| CN | 104066585 | 9/2014 |
| EP | 1566274 | 9/2016 |
| EP | 3099493 | 12/2016 |
| JP | 2008200902 | 9/2008 |
| JP | 2009226942 | 10/2009 |
| JP | 2011073435 | 4/2011 |
| JP | 2013532594 | 8/2013 |
| JP | 2014054844 | 3/2014 |
| JP | 2014522755 | 9/2014 |
| JP | 2014531349 | 11/2014 |
| JP | 2014237323 | 12/2014 |
| JP | 2016511717 | 4/2016 |
| JP | 2016515952 | 6/2016 |
| JP | 2017513741 | 6/2017 |
| JP | 2017124614 | 7/2017 |
| JP | 2017124615 | 7/2017 |
| TW | 201304971 | 2/2013 |
| WO | WO-2011146149 | 11/2011 |
| WO | WO-2014042625 | 3/2014 |
| WO | WO-2014133517 | 9/2014 |
| WO | WO-2015041665 | 3/2015 |
| WO | WO-2016137490 | 9/2016 |
| WO | WO-2017065728 | 4/2017 |
| WO | WO-2017065730 | 4/2017 |
| WO | WO-2017074354 | 5/2017 |
| WO | WO-2017098962 | 6/2017 |

* cited by examiner

FLUIDIC EJECTION DIES WITH ENCLOSED CROSS-CHANNELS

BACKGROUND

A fluidic ejection die is a component of a fluid ejection system that includes a number of fluid ejecting nozzles. The fluidic die can also include other non-ejecting actuators such as micro-recirculation pumps. Through these nozzles and pumps, fluid, such as ink and fusing agent among others, is ejected or moved. For example, nozzles may include an ejection chamber that holds an amount of fluid, a fluid actuator within the ejection chamber operates to eject the fluid through an opening of the nozzle.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
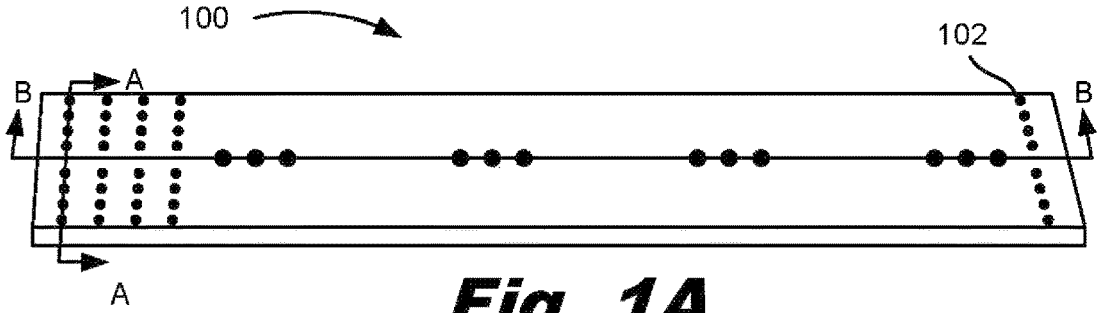
FIGS. 1A-1D are views of a fluidic ejection die with enclosed cross-channels, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include fluidic ejection dies, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In a specific example, these fluidic dies are found in any number of printing devices such as inkjet printers, multifunction printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid ejection systems dispense ink on a two-dimensional print medium such as paper. For example, during inkjet printing, fluid is directed to a fluid ejection die. Depending on the content to be printed, the device in which the fluid ejection die is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used. Accordingly, as has been described, the systems and methods described herein may be implemented in two-dimensional printing, i.e., depositing fluid on a substrate, and in three-dimensional printing, i.e., depositing a fusing agent or other functional agent on a material base to form a three-dimensional printed product.

While such fluidic ejection dies have increased in efficiency in ejecting various types of fluid, enhancements to their operation can yield increased performance. For example, some fluidic ejection dies include resistive elements which force fluid through nozzle openings. In some examples, the fluid may include suspended particles that may move out of suspension and collect as sediment in certain areas within the fluidic ejection die. For example, pigment particles suspended in ink may tend to move out of suspension and collect within the ejection chamber of a nozzle. This can block the ejection of fluid and/or result in decreased print quality.

This sedimentation of particles may be corrected by including a number of recirculation pumps disposed within micro-recirculation channels within the fluidic ejection die. The recirculation pumps may be micro-resistive elements that reduce or eliminate pigment settling by recirculating the fluid through the ejection chambers of the fluidic ejection die.

However, the addition of the recirculation pumps, as well as the operation of fluid ejectors may cause an undesirable amount of waste heat to accumulate within the fluid, the fluidic ejection die, and other portions of the overall fluid ejection device. This increase in waste heat may cause thermal defects in the ejection of the fluid from the fluid ejection die, damage components of the fluidic ejection die, and reduce print quality.

Also, the desirable impact, of these micro-recirculation pumps is reduced due to fluid mechanics. For example, fluid is supplied to the fluidic ejection die via a fluid supply slot. A macro-recirculation system includes an external pump that drives fluid through these fluid supply slots. Due to the narrowness of the fluidic ejection die, this macro-recirculation flow may not penetrate deep enough into the fluid supply slot to be drawn into the micro-recirculation loop in the nozzle. That is the fluid supply slot separates the macro-recirculation flow from the micro-recirculation flow.

Accordingly, the fluid in the micro-recirculation loop is not replenished, but instead the same volume of fluid is recycled through the loop. Doing so has a deleterious effect on the nozzles. For example, during operation, after a number of actuations via the micro-fluidic pumps and the fluid ejectors, portions of the fluid evaporate such that the fluid becomes depleted of water. Fluid that is depleted of water can negatively impact the nozzles and can result in reduced print quality.

Accordingly, the present specification describes a fluidic ejection die that solves these and other issues. That is, the present specification describes a system and method that forces flow into the fluidic ejection die, in a transverse direction. In this example, a die slot is replaced with an inlet port and an outlet, port that are linked to enclosed cross-channels on the back of the fluidic ejection die. More specifically, nozzles through which fluid is ejected are disposed on a front surface of the fluidic ejection die. Fluid is supplied to these nozzles via the backside. The enclosed cross-channels promote flow closer to the fluidic ejection die. That is, without the enclosed cross channels, fluid that is supplied to an inlet of the fluidic ejection die by the supply slots has a low velocity, insufficient to come close to the micro-recirculation loops. In this example, fluid is circulating throughout the microfluidic loops, but the fluid is not replenished from the fluid supply.

The enclosed cross-channels, via fluid dynamics, increase the flow close to the micro-recirculation loops such that they are replenished with new fluid. That is, the micro-recirculation flow draws fluid from, and ejects fluid into a macro-recirculation flow traveling through the enclosed cross-channels. Accordingly, in this example, the micro-recirculation loop and nozzles are provided with new, fresh fluid.

That is, a micro-recirculation pump draws fluid into, and ejects fluid out of, passages in a pulsating manner that creates secondary flows and vortices. These vortices dissipate a certain distance from the passages. The enclosed cross-channels draw the macro-recirculating flow directly to these vortices such that the macro-recirculating fluid interacts with these vortices at sufficient flow velocity so that mixing between the macro-recirculating fluid and the fluid in the micro-recirculation loop is accelerated. Without the enclosed cross-channels to force the macro-recirculating fluid to close proximity of the micro-recirculation loops, the macro-recirculating fluid will not reach into a fluid supply slot with sufficient velocity to interact with the vortices around entrances/exits of the micro-recirculation loop. This increased flow also enhances cooling as fresh ink is more effective at drawing heat from the fluidic ejection die than is depleted, or recycled, fluid.

Specifically, the present specification describes a fluidic ejection die. The fluidic ejection die includes an array of nozzles to eject an amount of fluid. Each nozzle includes an ejection chamber to hold an amount of fluid; an opening to dispense the amount of fluid; and a fluid actuator, disposed within the ejection chamber, to eject the amount of fluid through the opening. The fluidic ejection die also includes an array of passages, formed in a substrate, to deliver fluid to and from the ejection chambers. The fluidic ejection die also includes an array of enclosed cross-channels, formed on a back surface of the substrate. Each enclosed cross-channel of the array of enclosed cross-channels is fluidly connected to a respective plurality of passages of the array of passages.

The present specification also describes a printing fluid cartridge. The printing fluid cartridge includes a housing and a reservoir disposed within the housing to contain fluid to be deposited on a substrate. The cartridge also includes an array of fluidic ejection dies disposed on the housing. Each fluidic ejection die includes an array of nozzles to eject an amount of fluid. Each nozzle includes an ejection chamber to hold the amount of fluid, an opening to dispense the amount of fluid, and a fluid actuator, disposed within the ejection chamber, to eject the amount of fluid through the opening. The fluidic ejection die also includes 1) an array of passages formed on a substrate to deliver fluid to and from ejection chambers and 2) an array of enclosed cross-channels, formed on a back surface of the substrate. Each enclosed cross-channel of the array of enclosed cross-channels is fluidly connected to a respective plurality of passages of the array of passages.

The present specification also describes a method for making a fluidic ejection die. According to the method, an array of nozzles and corresponding passages through which fluid is ejected are formed. A number of enclosed cross-channels are also formed. Each enclosed cross-channel of the array of enclosed cross-channels is fluidly connected to a respective plurality of passages of the array of passages. The array of nozzles and passages are then joined to the number of enclosed cross-channels.

In summary, using such a fluidic ejection die 1) reduces the likelihood of decap by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, and 7) allows for re-priming of the nozzle. However, it is contemplated that the devices disclosed herein may address other matters and deficiencies in a number of technical areas.

As used in the present specification and in the appended claims, the term "actuator" refers a nozzle or another non-ejecting actuator. For example, a nozzle, which is an actuator, operates to eject fluid from the fluidic ejection die. A recirculation pump, which is an example of a non-ejecting actuator, moves fluid through the passages, channels, and pathways within the fluidic ejection die.

Accordingly, as used in the present specification and in the appended claims, the term "nozzle" refers to an individual component of a fluidic ejection die that dispenses fluid onto a surface. The nozzle includes at least an ejection chamber, an ejector fluid actuator, and a nozzle opening.

Further, as used in the present specification and in the appended claims, the term "printing fluid cartridge" may refer to a device used in the ejection of ink, or other fluid, onto a print medium. In general, a printing fluid cartridge may be a fluidic ejection device that dispenses fluid such as ink, wax, polymers or other fluids. A printer cartridge may include fluidic ejection dies. In some examples, a printer cartridge may be used in printers, graphic plotters, copiers and facsimile machines. In these examples, a fluidic ejection die may eject ink, or another fluid, onto a medium such as paper to form a desired image.

Even further, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIGS. 1A-1D are views of a fluidic ejection die (100) with enclosed cross-channels (104), according to an example of the principles described herein. Specifically, FIG. 1A is an isometric view of the fluidic ejection die (100). As described above, the fluidic ejection die (100) refers to a component of a printing system used in depositing printing fluids onto a substrate. To eject the printing fluid onto the substrate, the fluidic ejection die (100) includes an, array of nozzles (102). For simplicity in FIG. 1A, one nozzle (102) has been indicated with a reference number. Moreover, it should be noted that the relative size of the nozzles (102) and the fluidic ejection die (100) are not to scale, with the nozzles being enlarged for purposes of illustration.

The nozzles (102) of the fluidic ejection die (100) may be arranged in columns or arrays such that properly sequenced ejection of fluid from the nozzles (102) causes characters, symbols, and/or other graphics or images to be printed on the print medium as the fluidic ejection die (100) and print medium are moved relative to each other.

In one example, the nozzles (102) in the array may be further grouped. For example, a first subset of nozzles (102) of the array may pertain to one color of ink, or one type of fluid with a set of fluidic properties, while a second subset of nozzles (102) of the array may pertain to another color of ink, or fluid with a different set of fluidic properties.

The fluidic ejection die (100) may be coupled to a controller that controls the fluidic ejection die (100) in ejecting fluid from the nozzles (102). For example, the controller defines a pattern of ejected fluid drops that form characters, symbols, and/or other graphics or images on the print medium. The pattern of ejected fluid drops is determined by the print job commands and/or command parameters received from a computing device.

Figure 1B:
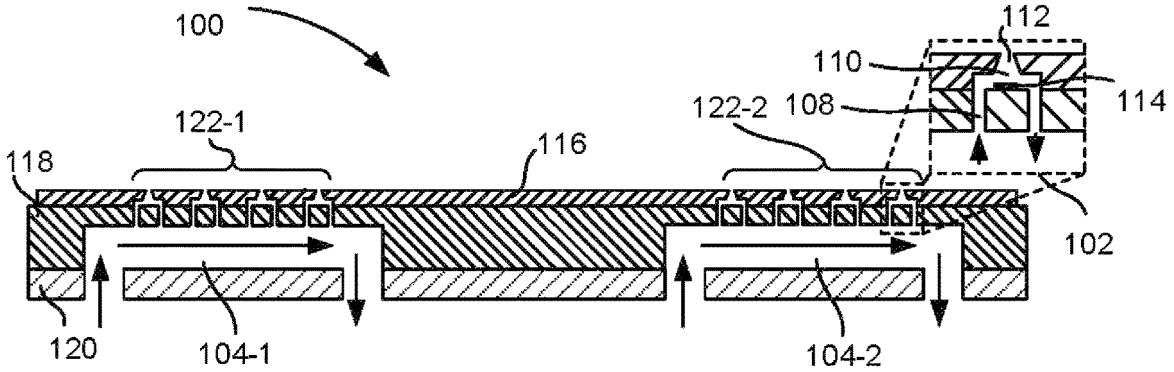
Figure 1C:
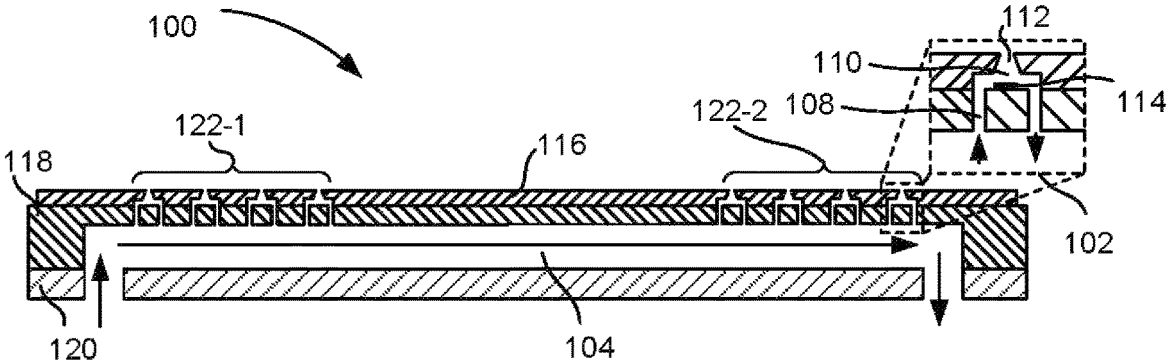

FIGS. 1B and 1C are cross-sectional views of the fluidic ejection die (100). More specifically, FIGS. 1B and 1C are cross-sectional views taken along the line A-A in FIG. 1A. FIG. 1B and FIG. 1C each illustrate a particular type of enclosed cross-channel (104). Note that in FIGS. 1B and 1C, the reference numbers 104 refers to the enclosed cross-channel and not the fluid flow, which fluid flow indicated by the arrows.

Among other things, FIGS. 1B and 1C depict a nozzle (102) of the array. For simplicity, one nozzle (102) in FIGS. 1B and 1C is depicted with a reference number. To eject fluid, the nozzle (102) includes a number of components. For example, a nozzle (102) includes an ejection chamber (110) to hold an amount of fluid to be ejected, an opening (112) through which the amount of fluid is ejected, and an ejecting fluid actuator (114), disposed within the ejection chamber (110), to eject the amount of fluid through the opening (112). The ejection chamber (110) and nozzle opening (112) may be defined in a nozzle substrate (116) that is deposited on top of a channel substrate (118). In some examples, the nozzle substrate (116) is formed of SU-8 or other material.

Turning to the ejecting actuators (114), the ejecting fluid actuator (114) may include, a firing resistor or other thermal device, a piezoelectric element, or other mechanism for ejecting fluid from the ejection chamber (110). For example, the ejector (114) may be a firing resistor. The firing resistor heats up in response to an applied voltage. As the firing resistor heats up, a portion of the fluid in the ejection chamber (110) vaporizes to form a bubble. This bubble pushes fluid out the opening (112) and onto the print medium. As the vaporized fluid bubble pops, fluid is drawn into the ejection chamber (110) from a passage (108), and the process repeats. In this example, the fluidic ejection die (100) may, be a thermal inkjet (TIJ) fluidic ejection die (100).

In another example, the ejecting fluid actuator (114) may be a piezoelectric device. As a voltage is applied, the piezoelectric device changes shape which generates a pressure pulse in the ejection chamber (110) that pushes the fluid out the opening (112) and onto the print medium. In this example, the fluidic ejection die (100) may be a piezoelectric inkjet (PIJ) fluidic ejection die (100).

The fluidic ejection die (100) also includes an array of passages (108) that are formed in a channel substrate (118). The passages (108) deliver fluid to and from the corresponding ejection chamber (110). In some examples, the passages (108) are formed in a perforated membrane of the channel substrate (118). For example, the channel substrate (118) may be formed of silicon, and the passages (108) may be formed in a perforated silicon membrane that forms part of the channel substrate (118). That is, the membrane may be perforated with holes which, when joined with the nozzle substrate (116), align with the ejection chamber (110) to form paths of ingress and egress of fluid during the ejection process. As depicted in FIGS. 1B and 1C, two passages (108) may correspond to each ejection chamber (110) such that one passage (108) of the pair is an inlet to the ejection chamber (110) and the other passage (108) is an outlet from the ejection chamber (110). In some examples, the passages may be round holes, square holes with rounded corners, or other type of passage.

The fluidic ejection die (100) also includes an array of enclosed cross-channels (104). The enclosed cross-channels (104) are formed on a backside of the channel substrate (118) and deliver fluid to and from the passages (108). In one example, each enclosed cross-channel (104) is fluidly connected to a respective plurality of passages (108) of the array of passages (108). That is, fluid enters an enclosed cross-channel (104), passes through the enclosed cross-channel (104), passes to respective passages (108), and then exits the enclosed cross-channel (104) to be mixed with other fluid in the associated fluidic delivery system. In some examples, the fluid path through the enclosed cross-channel (104) is perpendicular to the flow through the passages (108) as indicated by the arrows. That is, fluid enters an inlet, passes through the enclosed cross-channel (104), passes to respective passages (108), and then exits an outlet to be mixed with other fluid in the associated fluidic delivery system. The flow through the inlet, enclosed cross-channel (104) and outlet is indicated by arrows in FIGS. 1B and 1C.

Figure 1D:
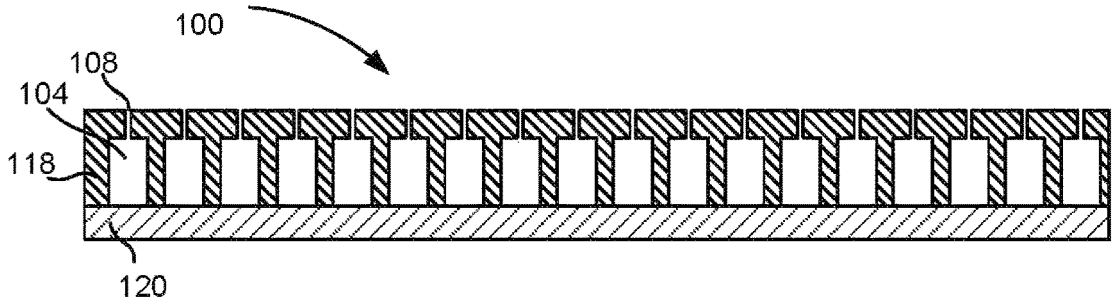

The enclosed cross-channels (104) are defined by any number of surfaces. For example, one surface of an enclosed cross-channel (104) is defined by the membrane portion of the channel substrate (118) in which the passages (108) are formed. Another surface is defined by a lid substrate (120) and the other surfaces are defined by ribs as indicated in FIG. 1D.

The individual cross-channels (104) of the array may correspond to passages (108) and corresponding ejection chambers (110) of a particular row. For example, as depicted in FIG. 1A, the array of nozzles (102) may be arranged in rows, and each cross-channel (104) may align with a row, such that nozzles (102) in a row share the same cross-channel (104). While FIG. 1A depicts the rows of nozzles (102) in a straight line, the rows of nozzles (102) may be angled, curved, chevron-shaped, or otherwise oriented. Accordingly, in these examples, the enclosed cross-channels (104) may be similarly, angled, curved, chevron-shaped, or otherwise oriented to align with the arrangement of the nozzles (102). In another example, passages (108) of a particular row may correspond to multiple cross-channels (104). That is, the rows may be straight, but the enclosed cross-channels (104) may be angled. While specific reference is made to an enclosed cross-channel (104) per row of nozzles (102), in some examples, multiple rows of nozzles (102) may correspond to a single enclosed cross-channel (104).

In some examples, the enclosed cross-channels (104) deliver fluid to rows of different subsets of the array of passages (108). For example, as depicted in FIG. 1C, a single enclosed cross-channel (104) may deliver fluid to a row of nozzles (102) in a first subset (122-1) and a row of nozzles (102) in a second subset (122-2). In this example, one type of fluid, for example, one ink color, can be provided to the different subsets (122). In a specific example, a mono-chrome fluidic ejection die (100) may implement one enclosed cross-channel (104) across multiple subsets (122) of nozzles (102).

In some examples, the enclosed cross-channels (104) deliver fluid to rows of a single subset (122) of the array of passages (108). For example, as depicted in FIG. 1B, a first cross-channel (104-1) delivers fluid to a row of nozzles (102) in a first, subset (122-1) and a second cross-channel (104-2) delivers fluid to a row of nozzles (102) in a second subset (122-2). In this example, different types of fluid, for example, different ink colors, can be provided to the different subsets (122). Such fluidic ejection dies (100) may be used in multi-color printing fluid cartridges.

These enclosed cross-channels (104) promote increased fluid flow through the fluidic ejection die (100). For example, without the enclosed cross-channels (104), fluid passing on a backside of the fluidic ejection die (100) may not pass close enough to the passages (108) to sufficiently mix with fluid passing through the nozzles (102). However, the enclosed cross-channels (104) draw fluid closer to the nozzles (102) thus facilitating greater fluid mixing. The increased fluid flow also improves nozzle health as used fluid is removed from the nozzles (102), which used fluid, if recycled throughout the nozzle (102), can damage the nozzle (102).

FIG. 1D is a cross-sectional views of the fluidic ejection die (100). More specifically, FIG. 1D is a cross-sectional view taken along the line B-B in FIG. 1A. FIG. 1D depicts a number of enclosed cross-channels (104) along the length of a fluidic ejection die (100). While FIG. 1D depicts a certain number of enclosed cross-channels (104), the fluidic ejection die (100) may include any number of these enclosed cross-channels (104).

FIG. 1D also depicts passages (108) through which fluid is passed to an ejection chamber (110). For simplicity, a single instance of the passage (108) and enclosed cross-channel (104) are depicted with reference numbers. While FIG. 1D illustrates the ribs that in part define the enclosed cross-channels (104) as being formed from the channel substrate (118), in some examples, the enclosed cross-channels may be formed from the lid substrate (120) which lid substrate (120) may be formed of glass, silicon, or other material.

Figure 2:
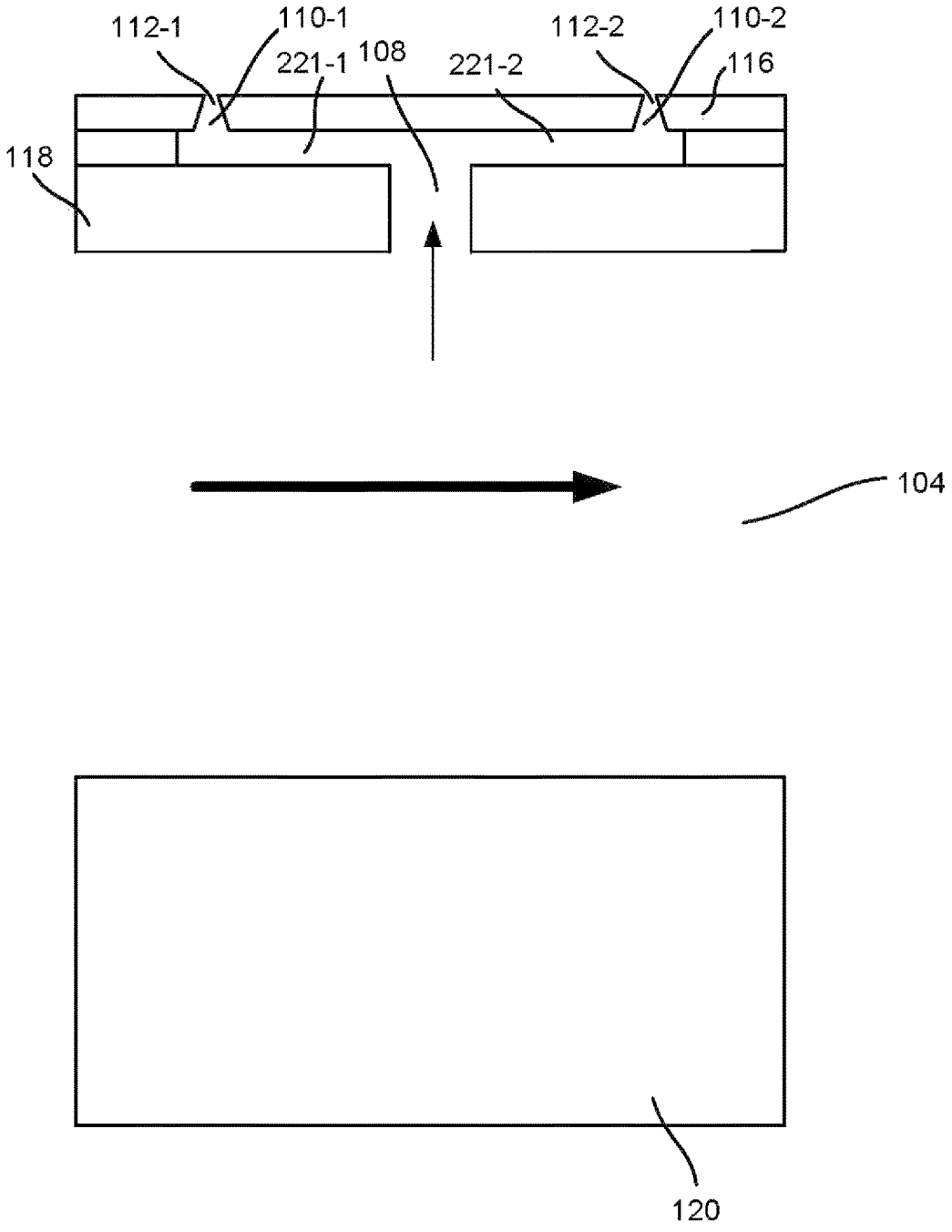
FIG. 2 is a cross-sectional view of a fluidic ejection die with enclosed cross-channels, according to an example of the principles described herein.

FIG. 2 is a cross-sectional view of a fluidic ejection die (FIG. 1, 100) with enclosed cross-channels (104), according to an example of the principles described herein. Specifically, FIG. 2 depicts a portion of the enclosed cross-channel (104) that passes underneath a single passage (108). Note that the elements depicted in FIG. 2 are not drawn to scale, and are enlarged for illustration purposes. FIG. 2 clearly depicts the fluid flow through the enclosed cross-channel (104) and the passage (108). As depicted, such fluid flow is perpendicular. That is, as the fluid flows through the enclosed cross-channel (104), it changes direction perpendicularly as it passes through the passage (108) to be directed to the nozzles (FIG. 1, 102).

In some examples, in addition to the ejecting fluid actuators (FIG. 1, 114), ejection chambers (110-1, 110-2), and openings (112-1, 112-2), each nozzle (FIG. 1, 102) may include a channel (221-1, 221-2) to direct fluid to and from the corresponding ejection chambers (110). Such channels (221) may be of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). In this example, the channels (221-1, 221-2) and the passages (108) that correspond to the nozzle (FIG. 1, 102) form a micro-recirculation loop. In some examples, a pump fluid actuator is disposed within a channel (221) to move the fluid to and from the ejection chamber (110). Such micro-channels (221-1, 221-2) prevent sedimentation of the fluid passing there through and ensures that fresh fluid is available for ejection through the opening (112). The fluid actuators, both the ejectors (FIG. 1, 114) and the pump actuators may be electrostatic membrane actuator, a mechanical/impact driven membrane actuator, a magnetostrictive drive actuator, or other such elements that may cause displacement of fluid responsive to electrical actuation.

As described above, such micro-recirculation loops provide fresh fluid to the ejection chamber (110), thus increasing the effective life of a nozzle (FIG. 1, 102). This is because the nozzles (FIG. 1, 102) operate best when provided with fresh fluid.

Figure 3:
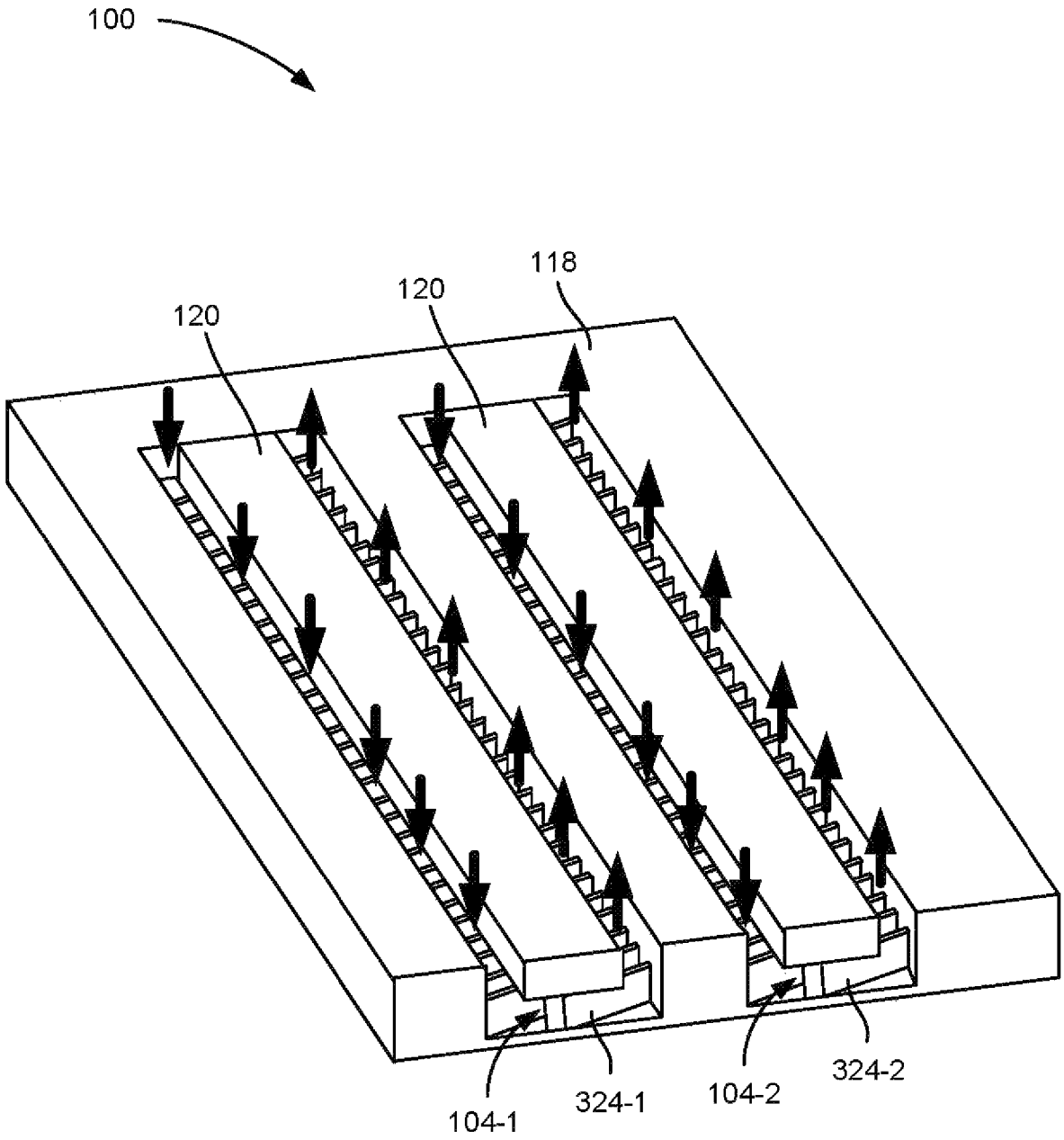
FIG. 3 is an isometric view of an underside of a fluidic ejection die with enclosed cross-channels, according to an example of the principles described herein.

FIG. 3 is an isometric view of an underside of a fluidic ejection die (100) with enclosed cross-channels (104-1, 104-2), according to an example of the principles described herein. For simplicity, a few instances of enclosed cross-channels (104-1, 104-2) and associated ribs (324-1, 324-2) are indicated with reference numbers.

FIG. 3 clearly depicts the fluid flow path through the fluidic ejection die (100), specifically, through the enclosed cross-channels (104). In the example depicted in FIG. 3, the array of nozzles (FIG. 1, 102) may be divided into two subsets (FIG. 2, 221-1, 221-2), however the array of nozzles (FIG. 1, 102) may be divided into any number of subsets (FIG. 2, 221).

In this example, fluid is passed into an inlet, which inlet may be shared by a number of enclosed cross-channels (104). The fluid then passes into the enclosed cross-channels (104), which enclosed cross-channels (104) are defined in part by ribs (324-1, 324-1) and the lid substrate (120). As fluid flows through the enclosed cross-channels (104) it is directed through the passages (FIG. 1, 108) and nozzles (FIG. 1, 102), which nozzles (FIG. 1, 102) may include micro-recirculation loops. Excess fluid is then transported back to the enclosed cross-channels (104) where it is expelled out an outlet of the enclosed cross-channels (104).

Figure 4:
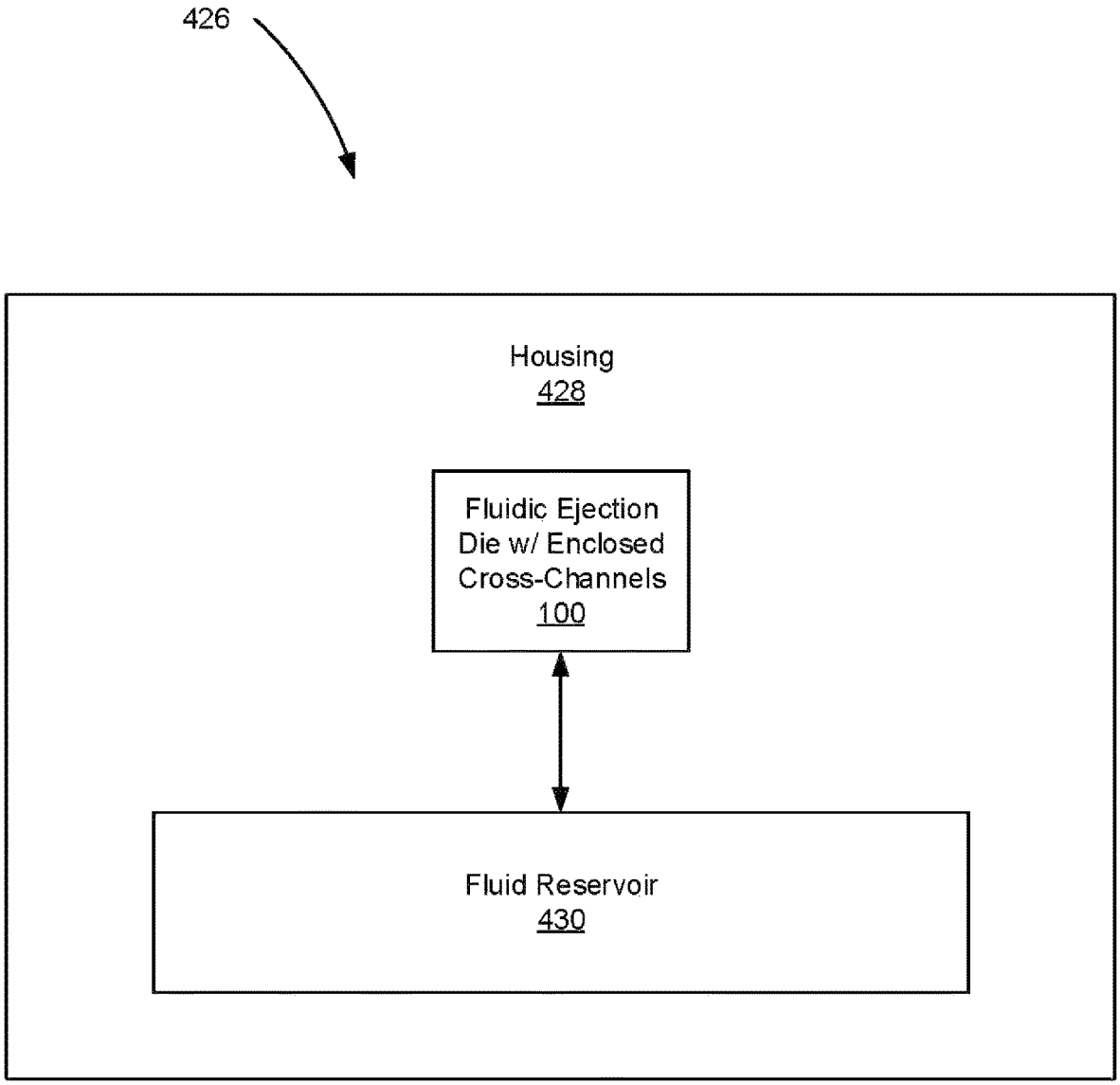
FIG. 4 is a block diagram of a printing fluid cartridge including a fluidic ejection die with enclosed cross-channels, according to an example of the principles described herein.

FIG. 4 is a block diagram of a printing fluid cartridge (426) including a fluidic ejection die (100) with enclosed cross-channels (FIG. 1, 104), according to an example of the principles described herein. The printing fluid cartridge (426) is used within a printing system to eject a fluid. In some examples, the printing fluid cartridge (426) may be removable from the system for example, as a replaceable cartridge (426). In some examples, the printing fluid cartridge (426) is a substrate-wide printbar and the array of fluidic ejection dies (100) are grouped into printheads that are staggered across a width of a substrate on which the fluid is to be deposited. An example of such a printhead is depicted in FIG. 6.

The printing fluid cartridge (426) includes a housing (428) to house components of the printing fluid cartridge (426). The housing (428) houses a fluid reservoir (430) to supply an amount of fluid to the fluidic ejection die (100). In general, fluid flows between the reservoir (430) and the fluidic ejection die (100). In some examples, a portion of the fluid supplied to fluidic ejection die (100) is consumed during operation and fluid not consumed during printing is returned to the fluid reservoir (430). In some examples, the fluid may be ink. In one specific example, the ink may be a water-based ultraviolet (UV) ink, pharmaceutical fluid, or 3D printing material, among other fluids.

Figure 5:
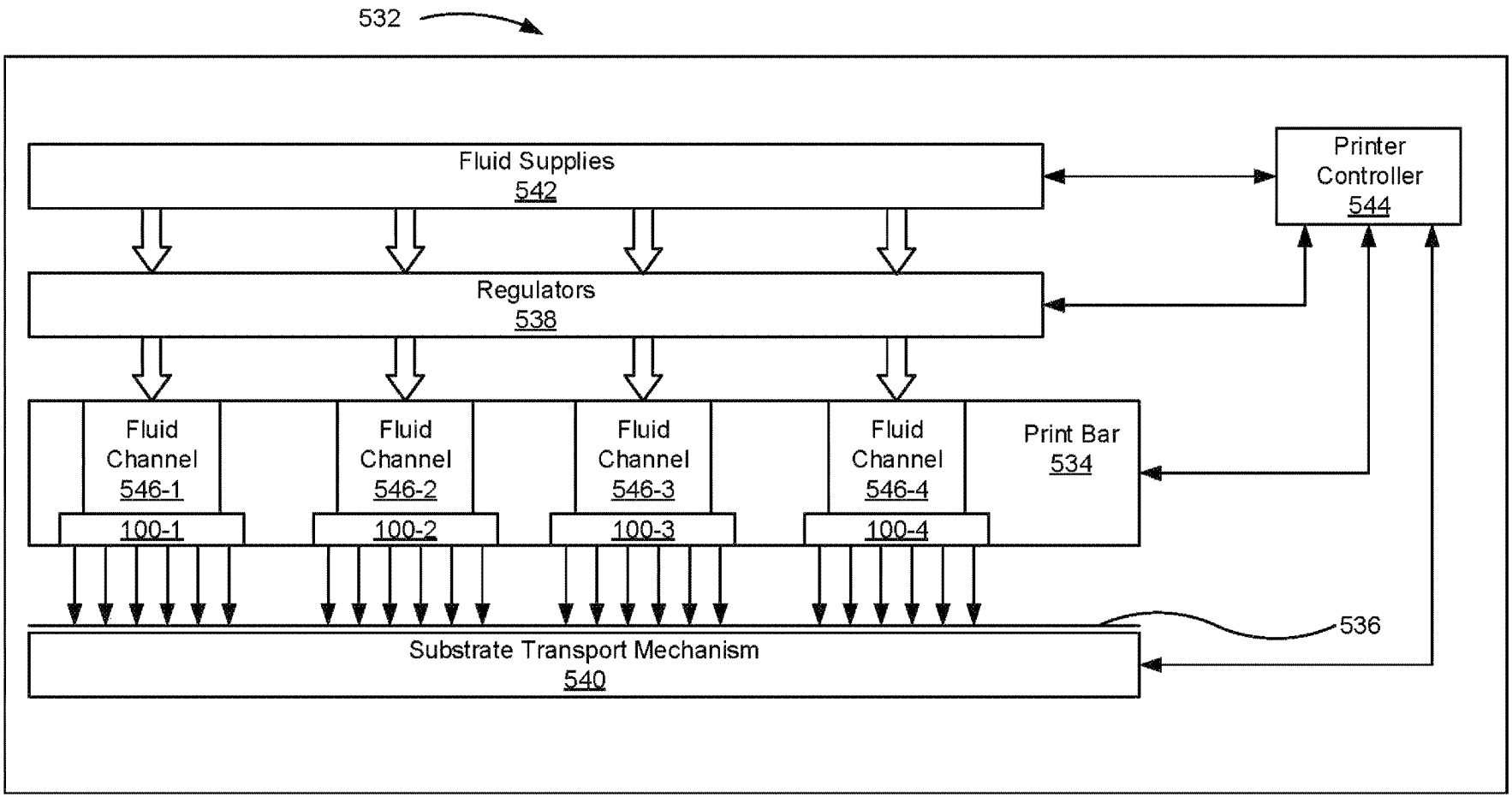
FIG. 5 is a block diagram of a printing device including a number of fluidic ejection dies with enclosed cross-channels in a substrate wide print bar, according to an example of the principles described herein.

FIG. 5 is a block diagram of a printing device (532) including a number of fluidic ejection dies (100-1, 100-2, 100-3, 100-4) with enclosed cross-channels (FIG. 1, 104) in a substrate wide printbar (534), according to an example of the principles described herein. The printing device (532) may include a printbar (534) spanning the width of a print substrate (536), a number of flow regulators (538) associated with the printbar (534), a substrate transport mechanism (540), printing fluid supplies (542) such as a fluid reservoir (FIG. 4, 430), and a controller (544). The controller (544) represents the programming, processor(s), and associated memories, along with other electronic circuitry and components that control the operative elements of the printing device (532). The printbar (534) may include an arrangement of fluidic ejection dies (100) for dispensing fluid onto a sheet or continuous web of paper or other print substrate (536). Each fluid ejection die (100) receives fluid through a flow path that extend from the fluid supplies (542) into and through the flow regulators (538), and through a number of transfer molded fluid channels (546) defined in the printbar (534).

Figure 6:
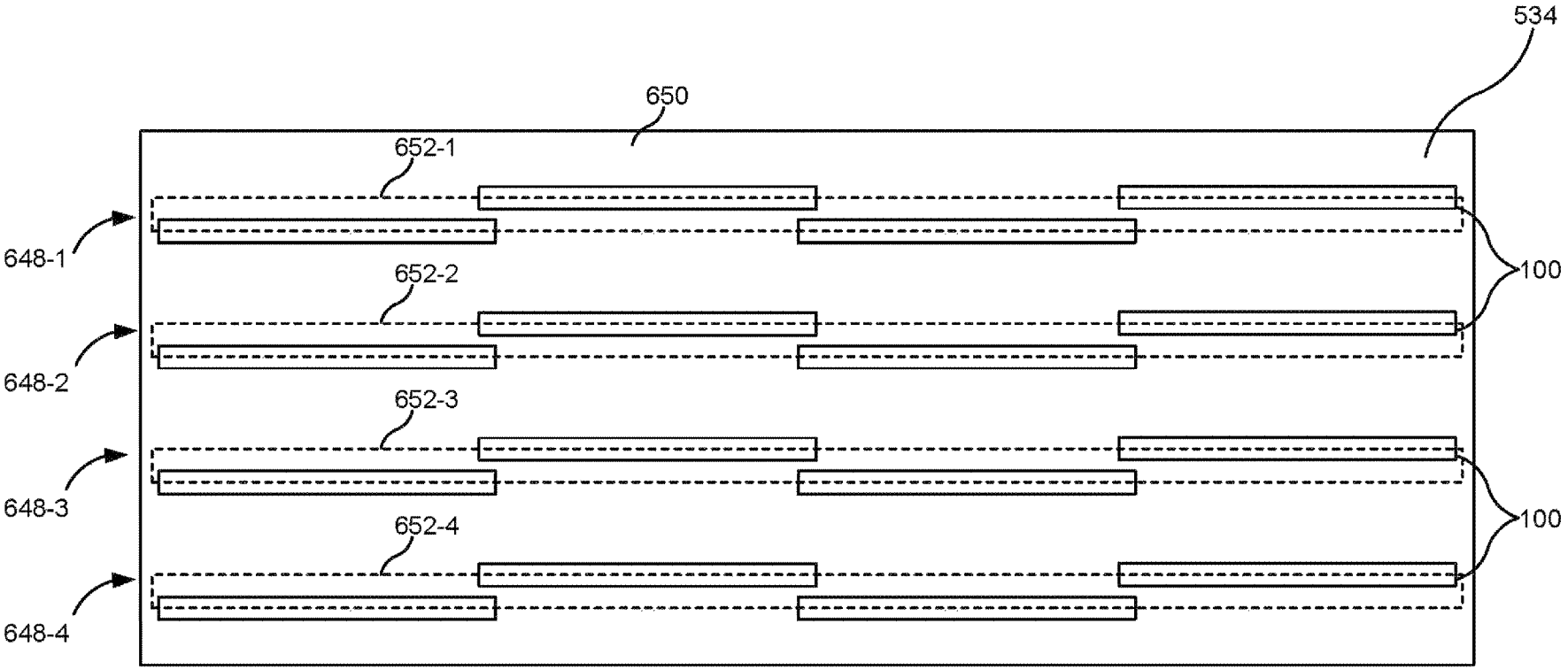
FIG. 6 is a block diagram of a print bar including a number of fluidic ejection dies with enclosed cross-channels, according to an example of the principles described herein.

FIG. 6 is a block diagram of a printbar (534) including a number of fluidic ejection dies (100) with enclosed cross-channels (FIG. 1, 104), according to an example of the principles described herein. In some examples, the fluid ejection dies (100) are embedded in an elongated, monolithic, molding (650) and arranged end to end in a number of rows (648). The fluid ejection dies (100) are arranged in a staggered configuration in which the fluid ejection dies (100) in each row (648) overlap another fluid ejection die (100) in that same row (648). In this arrangement, each row (648) of fluid ejection dies (100) receives fluid from a different transfer molded fluid channel (652) as illustrated with dashed lines in FIG. 6. While FIG. 6 depicts four fluid channels (652) feeding four rows (648) of staggered fluid ejection dies (100) is for example, when printing four different colors such as cyan, magenta, yellow, and black, other suitable configurations are possible.

Figure 7:
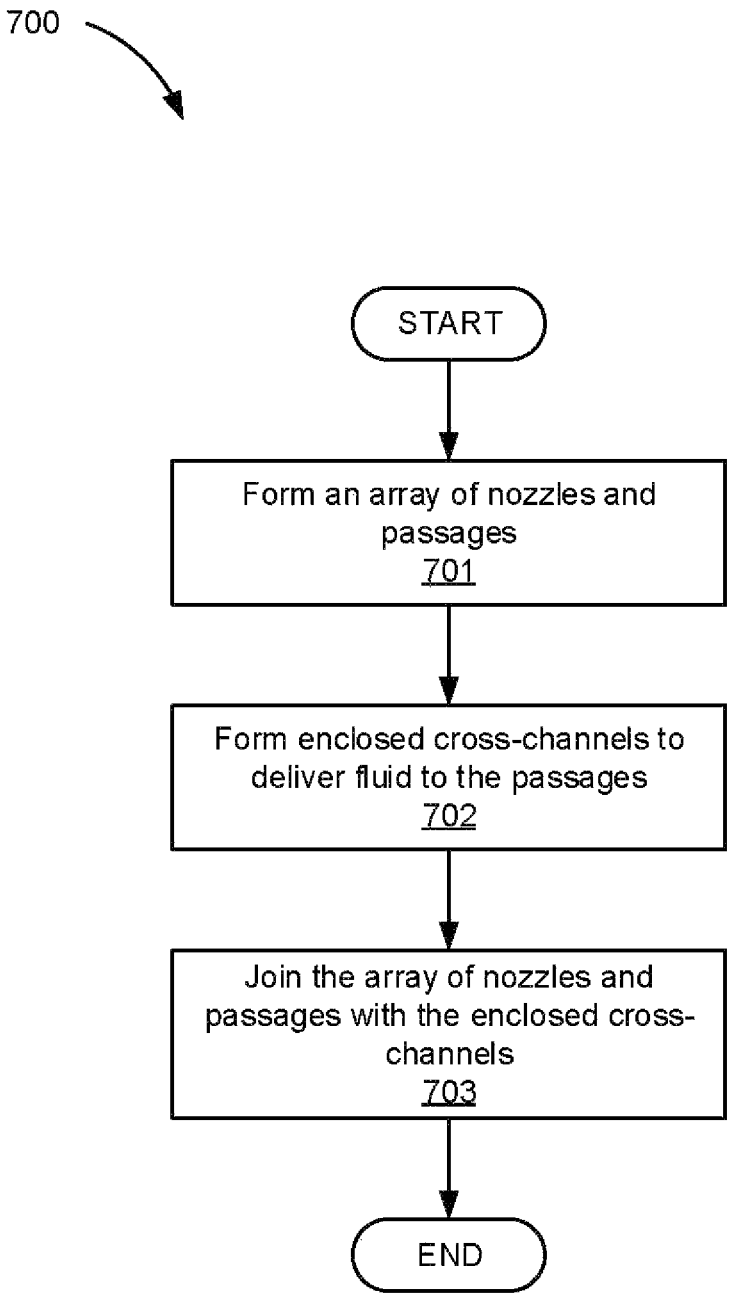
FIG. 7 is a flowchart of a method for forming, a fluidic ejection die with enclosed cross-channels, according to an example of the principles described herein.

FIG. 7 is a flowchart of a method (700) for forming a fluidic ejection die (FIG. 1, 100) with enclosed cross-channels (FIG. 1, 104), according to an example of the principles described herein. According to the method (700), an array of, nozzles (FIG. 1, 102) and passages (FIG. 1, 108) are formed (block 701). In some examples, the passages (FIG. 1, 108) may be part of a perforated silicon membrane. The nozzles (FIG. 1, 102), or rather the openings (FIG. 1, 112) and the ejection chambers (FIG. 1, 110) of the nozzles (FIG. 1, 102), may be formed of a nozzle substrate (FIG. 1, 116) such as SU-8. Accordingly, forming (block 701) the array of nozzles (FIG. 1, 102) and passages (FIG. 1, 108) may include joining the perforated silicon membrane with the SU-8 nozzle substrate (FIG. 1, 116).

Enclosed cross-channels (FIG. 1, 104) are then formed (block 702). Forming (block 702) the enclosed cross-channels (FIG. 1, 104) may include adhering ribs (FIG. 3, 324) to the backside of the membrane in which the passages (FIG. 1, 108) are formed and attaching a lid substrate (FIG. 1, 120). In another example the formation (block 702) may include etching away the channel substrate (FIG. 1, 118) to form the ribs (FIG. 3, 324) which define in part the enclosed cross-channels (FIG. 1, 104).

With the enclosed cross-channels (FIG. 1, 104) formed and the nozzles (FIG. 1, 102) and passages (FIG. 1, 108) formed, the two are joined (block 703) to form the fluidic ejection die (FIG. 1, 100) with enclosed cross-channels (FIG. 1, 104). FIGS. 8A-10D depict various examples of manufacturing a fluidic ejection die (FIG. 1, 104).

FIGS. 8A through 8D depict a method of manufacturing a fluidic ejection die (FIG. 1, 100) with enclosed cross-channels (FIG. 1, 104), according to an example of the principles described herein. For simplicity, within a given figure, one instance of each component is indicated with a reference number, even though multiple instances of those components may be illustrated.

Figure 8A:
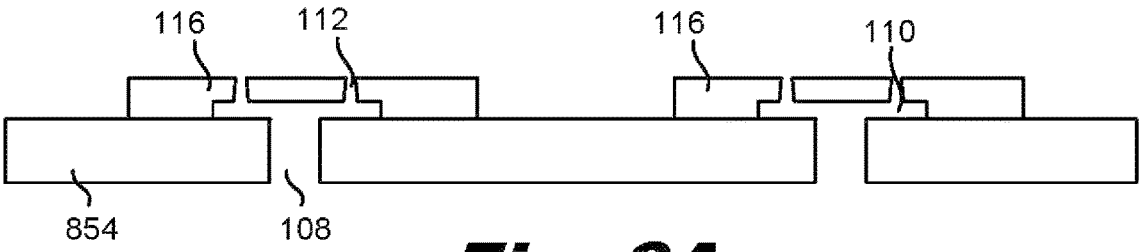
FIGS. 8A through 8D depict a method of manufacturing a fluidic ejection die with enclosed cross-channels, according to an example of the principles described herein.

First, In FIG. 8A, the nozzle openings (112) and ejection chambers (110) are formed in the nozzle substrate (116) which may be formed of a material such as SU-8. The formation of the openings (112) and ejection chambers (110) in the nozzle substrate (116) may be via etching or photolithography. This nozzle substrate (116) with openings (112) and ejection chambers (110) formed therein is then joined to a layer (854) that has passages (108) formed therein. Such a layer (854) may be a thin silicon membrane that has perforations that define the passages (108). In this example, the passages (108) may be formed to a predetermined depth, and the layer (854) thinned down until the passages (108) are exposed.

Figure 8B:
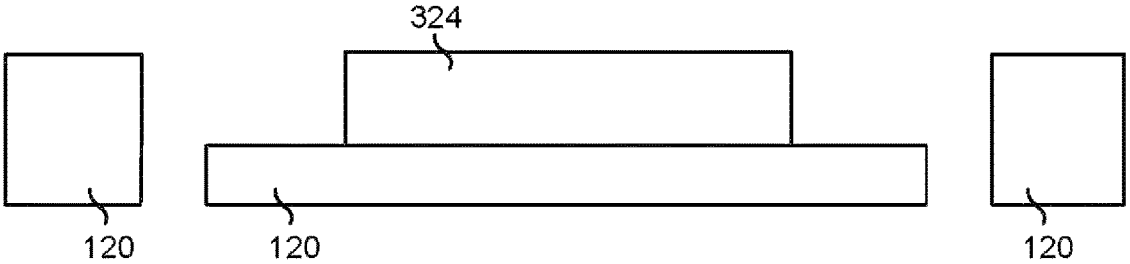

Next, in FIG. 8B, the ribs (324) that define the channels (FIG. 1, 104) may be formed. In some examples, this may include etching a portion of a silicon substrate to define the enclosed cross-channels (FIG. 1, 104), and further etching or laser ablating other portions of the substrate to define the inlet and outlet slots.

Figure 8C:
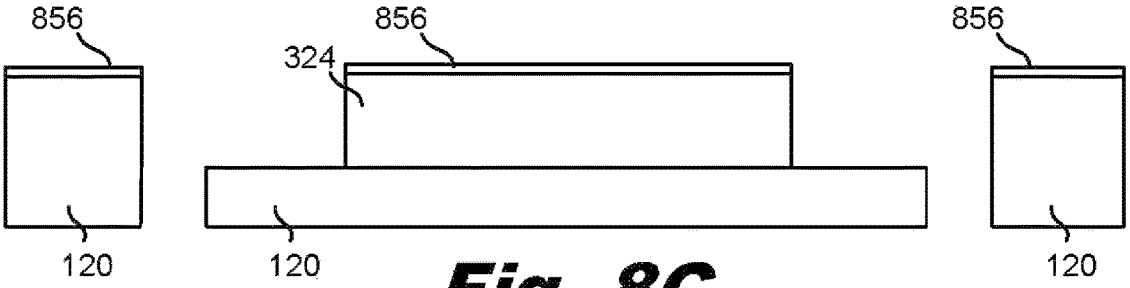
Figure 8D:
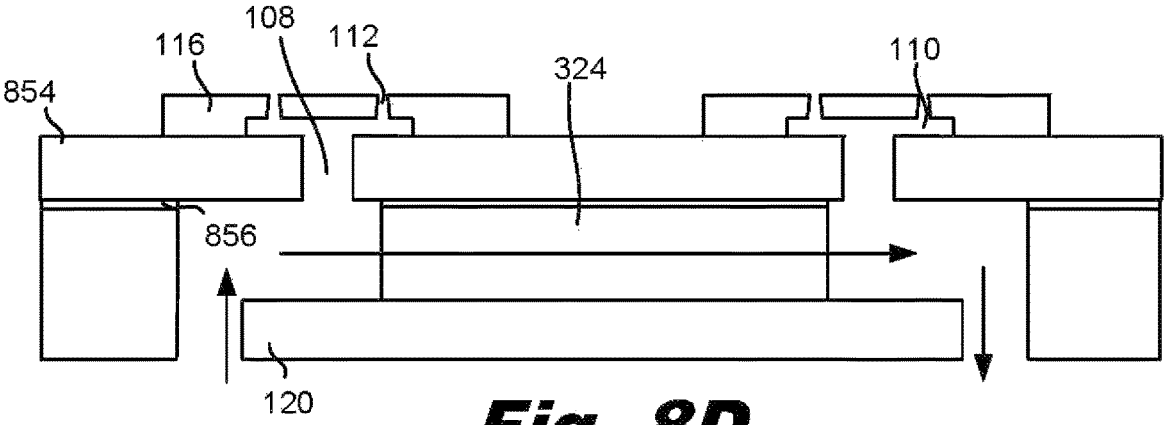

Then, as depicted in FIG. 8C, an adhesive (856) is placed on the lid substrate (120) and the ribs (324) and the structure that includes the nozzles (FIG. 1, 102) and passages (108) is joined to the ribs (324)/lid substrate (120) as depicted in FIG. 8D. Fluid then flows through an inlet in the enclosed cross-channel (FIG. 1, 104), past the ribs (324) into corresponding passages (108), and out the outlet.

Figure 9A:
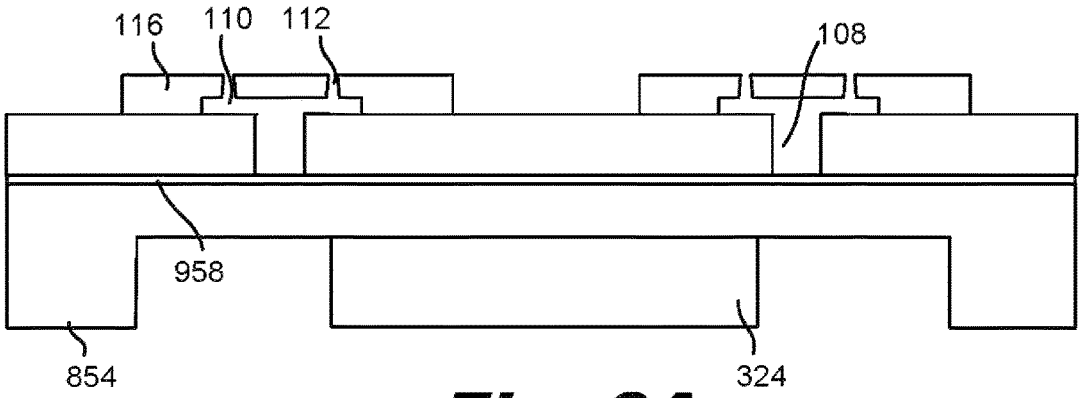
FIGS. 9A through 9D depict a method of manufacturing a fluidic ejection die with enclosed cross-channels, according to another example of the principles described herein.

FIGS. 9A through 9D depict a method of manufacturing a fluidic ejection die (FIG. 1, 100) with enclosed cross-channels (FIG. 1, 104), according to another example of the principles described herein. In this example, the nozzle substrate (116) that defines ejection chambers (110) and nozzle openings (112) is adhered to a substrate (854) such as a silicon membrane that is perforated to define passages (108). In this example, a layer (958) of silicon dioxide or another insulator, may be embedded in the substrate (854). Accordingly, in this example, the passages (108) may be formed in the substrate (854) by performing deep reactive ion etching (DRIE), on the substrate (854) which will form passages (108) through to the layer (958) of insulator material. FIG. 9A also depicts a portion of a first etching operation of a two-step etching operation to form the enclosed cross-channels (FIG. 1, 104). In this first portion of a first etching operation, a photoresist is put down that defines the enclosed cross-channels (FIG. 1, 104) including the ribs (324). A first etching operation is carried out on the silicon material to define the ribs (324) that define the enclosed cross-channels (FIG. 1, 104).

Figure 9B:
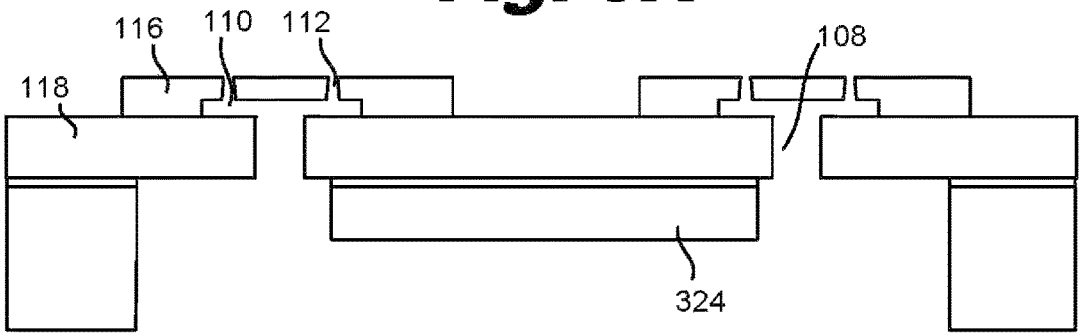

FIG. 9B depicts a second portion of the first etching operation and a second etching operation. In the second portion of the first etching operation, the photoresist is removed leaving a second masking layer which defines a window surrounding the ribs (324). The substrate (854) is further etched to 1) continue to define the ribs (324) as well as to form the window surrounding the ribs (324). Finally, during a third etching operation, the portion of the insulator layer (958) is removed to expose the passages (108) to the enclosed cross-channel (FIG. 1, 104).

Figure 9C:
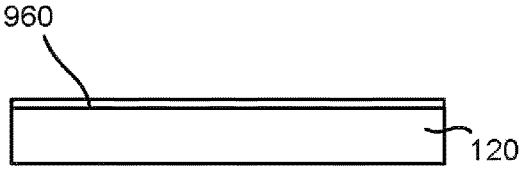
Figure 9D:
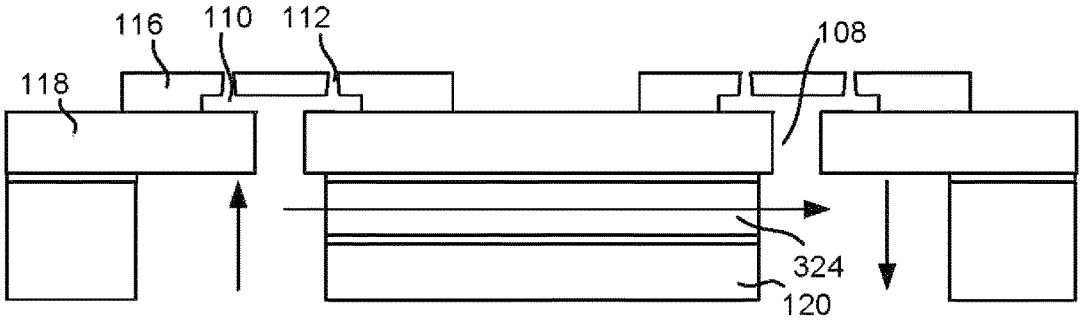

In FIG. 9C, adhesive (960) is disposed on top of the ribs (324) and the ribs (324) are adhered to the lid substrate (120) to form the enclosed cross-channels (FIG. 1, 104) as depicted in FIG. 9D. Fluid then flows through an inlet in the enclosed cross-channel (FIG. 1, 104), past the ribs (324) into corresponding passages (108), and out the outlet.

Figure 10A:
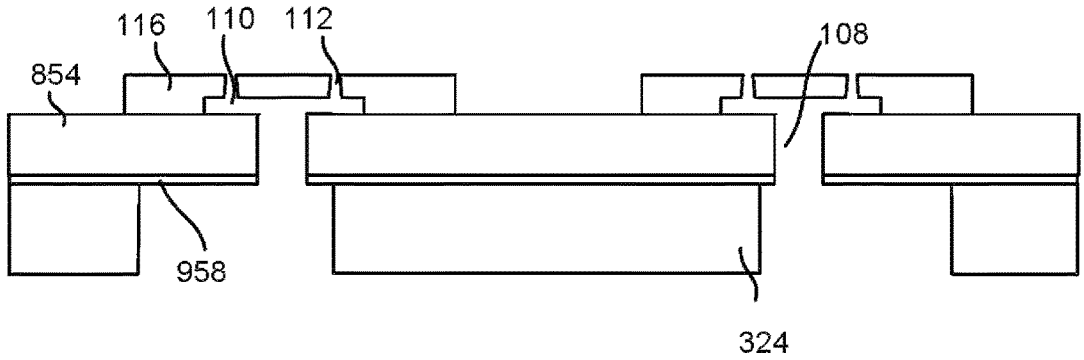
FIGS. 10A through 10D depict a method of manufacturing a fluidic ejection die with enclosed cross-channels, according to another example of the principles described herein.

FIGS. 10A through 10D depict a method of manufacturing a fluidic ejection die with enclosed cross-channels, according to another example of the principles described herein. In FIG. 10A, the nozzle substrate (116) that defines ejection chambers (110) and nozzle openings (112) is adhered to a substrate (854) such as a silicon membrane that is perforated to define passages (108), which substrate (854) has an embedded insulator layer (958) as described above in regards to FIGS. 9A-90. In this example, the substrate (854) is thinned down and a first etching operation is carried out using a photoresist on the silicon material to define the ribs (324) that define the enclosed cross-channels (FIG. 1, 104). A second etching operation is then carried out to etch away the insulator layer (958) to expose the passages (108).

Figure 10B:
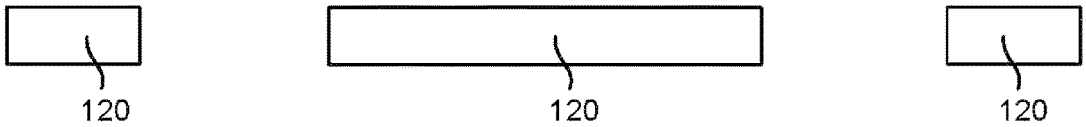
Figure 10C:
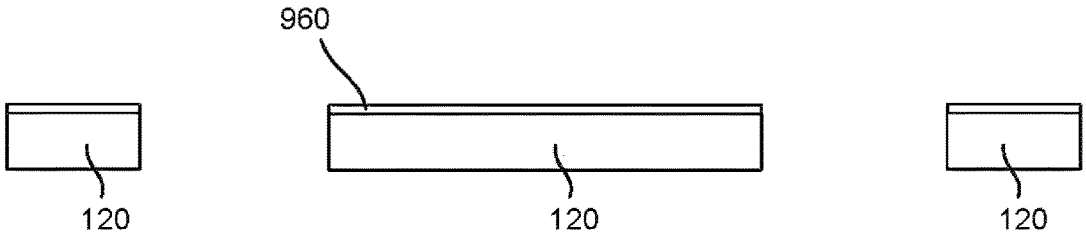
Figure 10D:
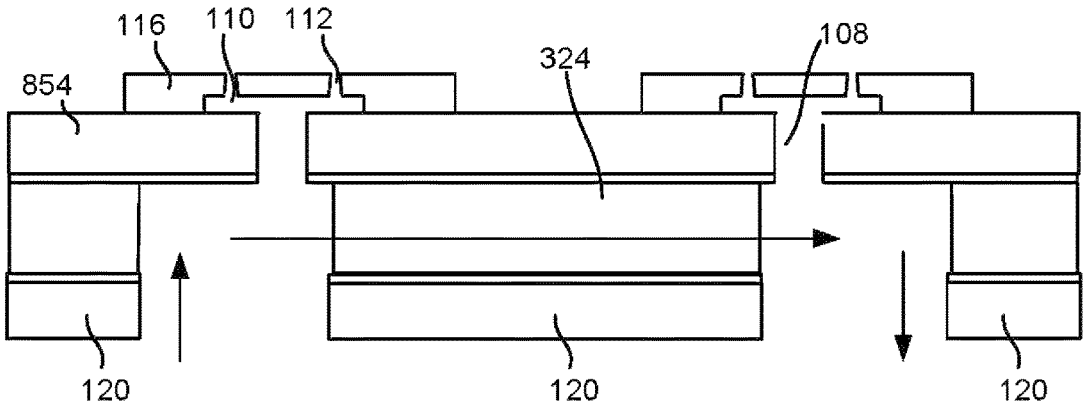

In FIG. 10B a lid substrate (120) with inlet and outlet slots is formed by etching or laser ablating slots, followed by wafer thinning using a wafer grinding operation to thin the substrate. In FIG. 10C, adhesive (960) is disposed on top of the ribs (324) and the lid substrate (120) is adhered to the ribs (324) to form the enclosed cross-channels (FIG. 1, 104) as depicted in FIG. 10D. Fluid then flows through an inlet in the enclosed cross-channel (FIG. 1, 104), past the ribs (324) into corresponding passages (108), and out the outlet.

In summary, using such a fluidic ejection die 1) reduces the likelihood of decap by maintaining water concentration in the fluid, 2) facilitates more efficient micro-recirculation within the nozzles, 3) improves nozzle health, 4) provides fluid mixing near the die to increase print quality, 5) convectively cools the fluidic ejection die, 6) removes air bubbles from the fluidic ejection die, and 7) allows for re-priming of the nozzle. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic ejection device, comprising:
- a macro-recirculation system comprising a supply slot to supply a fluid to an array of nozzles; and
- a fluidic ejection die, comprising:
  - the array of nozzles;
  - a micro-recirculation system per nozzle, the micro-recirculation system comprising:
    - a nozzle inlet passage;
    - the nozzle channel to direct fluid to and from an ejection chamber of the nozzle; and
    - a nozzle outlet passage; and
- an enclosed cross-channel fluidly connected to the macro-recirculation system and the micro-recirculation system.

2. The fluidic ejection device of claim 1, wherein fluid flow through the enclosed cross-channels is perpendicular to fluid ejection out the nozzle.

3. The fluidic ejection device of claim 1, further comprising:
- a first pump to drive the fluid through the supply slot; and
- a recirculation pump within the micro-recirculation system to recirculate the fluid through the ejection chamber.

4. The fluid ejection device of claim 1, wherein the nozzle inlet passage, nozzle outlet passage, and enclosed cross channels are formed in a single substrate.

5. The fluid ejection device of claim 1, wherein the enclosed cross-channel is fluidly connected to the micro-recirculation system of each nozzle in a row of nozzles.

6. The fluid ejection device of claim 1, further comprising:
- a first enclosed cross-channel fluidly connected to the micro-recirculation system of a first subset of nozzles in a row of nozzles; and
- a second enclosed cross-channel fluidly connected to the micro-recirculation system of a second subset of nozzles in the row of nozzles.

7. The fluid ejection device of claim 6, wherein the first enclosed cross-channel delivers a different fluid than the second enclosed cross-channel.

8. The fluid ejection device of claim 1, wherein passages of a row of nozzles correspond to multiple enclosed cross-channels.

9. The fluid ejection device of claim 1, wherein the supply slot has tapered walls.

10. The fluidic ejection device of claim 1, wherein:
- the array of nozzles is arranged in straight rows; and
- the enclosed cross-channel is at an angle offset from a row of nozzles.

11. A fluidic ejection device, comprising:
- a macro-recirculation system comprising a supply slot to supply a fluid to an array of nozzles;
- a fluid ejection die, comprising:
  - the array of nozzles;
  - a micro-recirculation system per nozzle, the micro-recirculation system comprising:
    - a nozzle inlet passage to provide fluid to a nozzle channel;
    - a nozzle channel to direct fluid to and from an ejection chamber of the nozzle; and
    - a nozzle outlet passage to direct fluid away from the nozzle channel;
  - an enclosed cross-channel fluidly connected to the macro-recirculation system and the micro-recirculation system;
- a cross-channel inlet passage from the supply slot to the enclosed cross-channel; and a cross-channel outlet passage from the enclosed cross-channel to the supply slot.

12. The fluidic ejection device of claim 11, wherein fluid flow through the enclosed cross-channels is perpendicular to each of:

fluid flow through the nozzle inlet passage;

fluid flow through the nozzle outlet passage;

fluid flow through the cross-channel inlet passage; and fluid flow through the cross-channel outlet passage.

13. The fluidic ejection device of claim 11, wherein the nozzle inlet passage and nozzle outlet passage are formed in a perforated membrane of a substrate in which the enclosed cross-channel is formed.

14. The fluidic ejection device of claim 11, wherein the cross-channel inlet passage and the cross-channel outlet passage are formed in a different substrate than a substrate in which the enclosed cross-channel is formed.

15. The fluidic ejection device of claim 11, wherein the cross-channel inlet passage is shared by multiple enclosed cross-channels.

16. The fluidic ejection device of claim 11, wherein the cross-channel outlet passage is shared by multiple enclosed cross-channels.

17. A printing fluid cartridge, comprising:

a housing;

a fluid reservoir within the housing to retain a supply of fluid; and a fluidic ejection device comprising:

a macro-recirculation system comprising a supply slot to supply a fluid to an array of nozzles; and a fluidic ejection die, comprising:

an array of nozzles;

a micro-recirculation system per nozzle, the micro-recirculation system comprising a nozzle inlet passage, a nozzle channel, and a nozzle outlet passage; and an enclosed cross-channel fluidly connected to the macro-recirculation system and the micro-recirculation system.

18. The printing fluid cartridge of claim 17, wherein the fluid is a fusing agent for a three-dimensional printer.

19. The printing fluid cartridge of claim 17, wherein fluid flow through the enclosed cross-channels is perpendicular to each of:

fluid flow through the nozzle inlet passage;

fluid flow through the nozzle outlet passage; and fluid ejection through the nozzle.

20. The printing fluid cartridge of claim 17, further comprising:

a moldable material in which the fluidic ejection die is disposed; and circuitry embedded in the moldable material.

* * * * *